US005280857A

United States Patent [19]

Reichner

[11] Patent Number: 5,280,857

[45] Date of Patent: Jan. 25, 1994

[54] FLUIDIZED IMPACT MILL

[76] Inventor: Thomas W. Reichner, 1826 Warriors Rd., Pittsburgh, Pa. 15205

[21] Appl. No.: 740,941

[22] Filed: Aug. 6, 1991

[51] Int. Cl.[5] ..... B02C 23/18

[52] U.S. Cl. ..... 241/5; 241/24; 241/81; 241/275

[58] Field of Search ..... 241/5, 24, 81, 275

[56] References Cited

U.S. PATENT DOCUMENTS

| | | | |
|---|---|---|---|
| 1,061,142 | 5/1913 | Tesla . | |
| 2,823,868 | 2/1958 | Scherer | 241/2 |
| 3,155,326 | 11/1964 | Rhodes | 241/275 X |
| 3,162,382 | 12/1964 | Danyluke | 241/275 X |
| 3,180,582 | 4/1965 | Danyluke | 241/275 |
| 3,261,559 | 7/1966 | Yavorsky et al. | 241/24 |
| 3,987,970 | 10/1976 | Burkett | 241/275 X |
| 3,995,784 | 12/1976 | de los Santos Izquierdo | 241/275 |
| 4,335,994 | 6/1982 | Gurth | 415/90 |
| 4,390,136 | 6/1983 | Burk | 241/275 |
| 4,575,014 | 3/1986 | Szalanski et al. | 241/275 |

*Primary Examiner*—Frank T. Yost
*Assistant Examiner*—Eugenia A. Jones
*Attorney, Agent, or Firm*—Armstrong & Kubovcik

[57] ABSTRACT

A comminuting device for breaking-up charge bodies of frangible material to free their value content and to reduce it to a desired size employs an upright enclosure into which charge bodies are fed so as to minimize in-air flow and to provide a steady stream of the bodies into the upper end of a centrally positioned downflow feed duct from which a series of horizontally, radially outwardly extending and vertically spaced-apart discs of a rotating assembly are suspended to define a central chamber selection passageway that is open at its upper end to the lower end of the duct, and at its bottom end through a grating to a motor drive compartment into which a fluid is introduced under positive pressure. The bodies are selectively introduced into vertically spaced and radially extending side chambers defined by the discs on the basis of their respective weights, with the lighter weight and usually smaller bodies being first introduced and those of greater weight being the last, all in a progressive manner as the bodies are fed downwardly from the duct into the passageway. On being introduced into the side chambers the bodies are subjected to implosion and then flung radially outwardly from within the chambers against outwardly offset abutment portions within the central chamber selection passageway portion of the enclosure and moved upwardly as finally broken up particles or particulates along the inside of the enclosure into an upper chamber that is disposed between its outer walls and the feed duct.

13 Claims, 3 Drawing Sheets (ENLARGED)

(REDUCED)

(ENLARGED)

FLUIDIZED IMPACT MILL

FIELD OF THE INVENTION

This invention relates to the comminuting of charge bodies of breakable material as suspended in a pressure fluid medium, such as air, an inert gas, etc. and particularly, to an improved and highly efficient approach to the breaking-up, crushing or pulverizing of hard or somewhat brittle or friable materials, such as bituminous coal, cement clinker, limestone, mineral ores, calcined alumina, etc. It also applies to material that may be made brittle as by freezing.

BACKGROUND OF THE INVENTION

There have been many prior art approaches to the comminuting of hard materials with the most common approach being the use of the hammer mill, ball grinding, jet milling, etc. They tend to involve a high degree of wear and tear on the apparatus, have high energy requirements, and lack means for enabling a flexible and accurate control as to the desired size and uniformity of size of the resulting product attained.

The need for a higher speed, lower energy consumption, low wear comminuting apparatus continues to be a priority for industry. Fossil fuel electric power generating stations must pulverize coal before it can be injected into their boilers. Currently available pulverizing methods (typically ball mills) pulverize at a slow rate, require recycling of oversize product, and require replacement of the balls as they wear out.

Similarly, mineral ores usually require that they be pulverized before processing to separate the mineral from its gangue. Roller mills, ball mills, and the like present problems for the processing company with their inherent slow speeds, size classification and subsequent recycling of oversize product, high energy consumption per ton of feed, equipment and media wear, etc.

Numerous other industrial bulk material processed experience similar problems in their size reduction requirements. This invention proposes to solve some of these problems with its extremely high speed, very low energy requirements per ton of feed, low wear on interior surface of the equipment, automatic internal air classification of the product, compact size of the equipment, ability to receive relatively large size feed while reducing to very fine size product, and easily performed maintenance when needed.

OBJECTS OF THE INVENTION

It has thus been an object of my invention to devise a new and improved approach to the comminuting of solid materials which will solve problems heretofore presented in the art.

Another object has been to devise an improved apparatus which will provide a very large change in size, from feed to product, in a very short period of time.

A further object has been to provide a comminuting apparatus that will also classify products by size internally during the comminution process.

A further object has been to devise a type of comminuting apparatus which will be saving of energy and will minimize wear and tear in its usage.

These and other objects will appear to those skilled in the art from the specification and the appended claims.

SUMMARY OF THE INVENTION

In devising an apparatus which will solve the present day problems that have been presented in this art, I make use of a horizontal screw feeder which minimizes the introduction of air, employing a central gravity down-flow of the charge and a supporting fluid up-flow, multiphase type of size reduction, size-selection and segregating operation.

The material or bodies charged are progressively fed or moved centrally axially downwardly under gravity from a centrally positioned feed duct axially into and downwardly along a fluid classifying zone defined by a centrally extending selection passageway, as opposed by a supportive positive pressure type of fluid up-flow, and into and along horizontal-radially extending, vertically disposed compartments or processing chambers of a rotating disc assembly on a selected basis as to their respective weights. The vertically disposed compartments or chambers are defined by centrally outwardly and inwardly open, radial, circular areas provided by a group or series of radially extending and vertically spaced-apart horizontal discs or plates. The charge material is fluidized and moved into the vertical compartments on a graduated basis, with the lightest weight portions entering the uppermost compartment and the material of heaviest weight entering the lowermost compartment. Within the compartments or chambers, the charge materials are subjected to a sudden vortex-like implosion, and then to a radial-outward centrifugal force action into outwardly offset striker wall areas or abutments, and those within a desired size are then flowed upwardly along or through side passageways into an upper commingling chamber. The discs are rotated about a central axis area along the lower extent of the inside of a generally rounded outer enclosing housing wall that has peripherally spaced-apart, outwardly offset and vertically extending shoulder areas, each having an abutment against which the charge material is thrown and broken by impact.

A horizontally extending motor-driven screw is used to continuously feed charge material lumps or pieces within a maximum size range into an upper end of a central down-extending hollow column or duct which delivers the charge material centrally downwardly along the series of radial, open-end compartments or zones defined by the assembly of spaced-apart discs.

I have determined that my apparatus and the procedure incident thereto avoids rounding the particles or particulate produced and causes the material pieces or lumps that are being introduced to break-up or pulverize along natural cleavage lines which, as to a fuel such as coal, represent natural areas along or within which sulfur or contaminating elements are found. The result is a releasing, separating-out of the non-combustible contaminants naturally present in run-of-mine coal. Volume of feed determines total volume of the chambers formed by the discs, top size of the feed determines duct diameter which delivers the charge material and disc spacing and required velocity of impact determines outside diameter of the discs.

In carrying out my invention, it is important to introduce a fluid flotation medium, such as air, separately in an upward, central-coaxial positive counter-flow path with respect to the introduction of a downward gravity flow of the charge material or portions being introduced along a vertically extending central duct and an axially aligned material selection passageway. Thus, the weight of a particular charge material portion will govern where or at which one of disc-defined horizontal radial chamber levels it terminates its central downward axial movement This occurs when the effective pressure force of the counter, up-flowing fluid medium is equal to or greater than the weight-induced gravity downflow of the charge material portion.

In the appropriate side chamber of the rotating disc assembly the charge material portion is then subjected to a vortex like, centrifugal force induced by the motor-driven plural chamber defining disc assembly which throws it against a breaking-up abutment positioned within an outwardly offset corner impact chamber area of the housing to which the disc-defined, radial side chamber is open. In this offset breaking-up area, charge portions of the material thus introduced also impinge against each other, are broken-up into particle or particulates of the desired size, or near desired size and then moved upwardly along a vertical side mounted passageway or ductway into an upper collecting or fluid classification chamber. The collecting chamber extends about the central downwardly extending, charge material feed-in duct. Such particles or particulates in the upper collecting chamber therein then commingle with particles or particulates being broken up from other, disc-defined, horizontal chamber zones or levels and that are moved upwardly, separately from each breaking-up of zone or level defined by the rotating disc assembly. A small amount of further breaking-up the collected particles occurs in this upper chamber to bring all particles within the final desired top size defined by the air volume discharge from the process.

DETAILED DESCRIPTION OF THE ILLUSTRATED INVENTION

Figure 1:
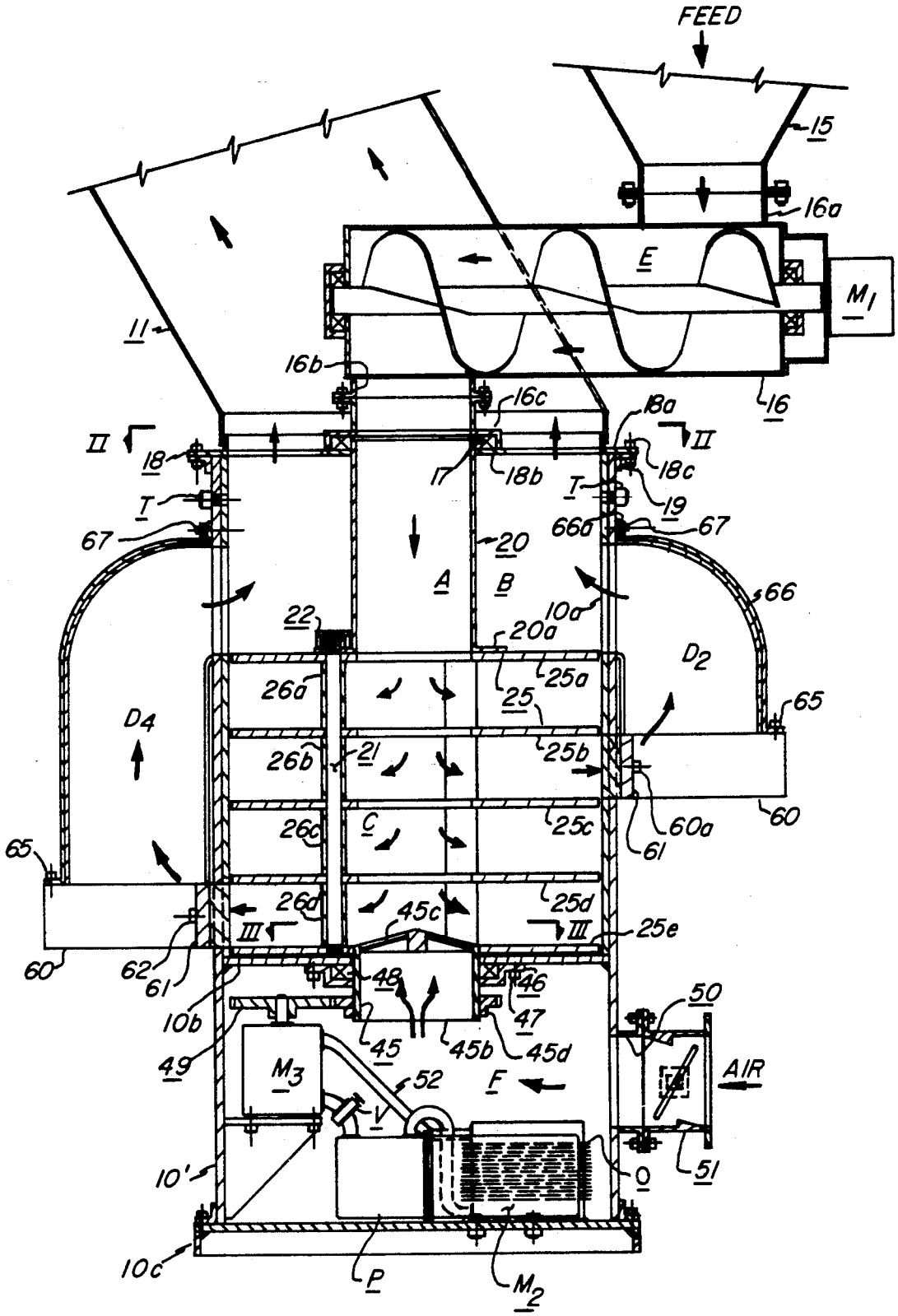
FIG. 1 is a vertical sectional view in elevation showing an apparatus or device constructed in accordance with my invention and with arrows indicating flow paths.

Referring to FIG. 1 which represents an operating embodiment of my invention, I show a substantially cylindrical or circular, vertically upwardly extending enclosure wall 10 which serves as a housing for my apparatus. Charge bodies are introduced from a vertical feed-in bin 15 into an upwardly open inlet collar portion 16*a* of a horizontally positioned screw feeder 16 that is shown as actuated by an electric motor $M_1$, to advance pre-sized bodies horizontally along an upper end of the enclosure or housing 10 and discharge them through a vertical outlet collar or flange 16*b* adjacent to its inner end into an upper, open end of a centrally extending, rotating cylindrical hollow shaft or duct 20. As shown in FIG. 1, the collar 16*b* is bolted to an intermediate connecting flange or collar 16*c* which with a transverse, central portion 18*b* of a fixedly mounted cover plate member 18, rotatably supports and carries an upper end of vertically downwardly extending, central, downfeed duct or hollow shaft 20 by means of a ring bearing 17. The shaft 20 is rotatably mounted and suspended centrally within the housing 10 between the upper bearing 17 and a lower ring bearing 48 to define an upper, outer, processed material size classification chamber B which surrounds an inner, centrally positioned, charge introducing chamber A. Processed particles are collected in chamber B for discharge through its upper open-end portion into a discharge duct 11 (see FIG. 1) and a suitable collecting means or bin (not shown). The cover plate 18 is secured by bolt and nut assemblies 18*c* to an upper flange 18*b* on which the bearing 17 rests.

Figure 3:
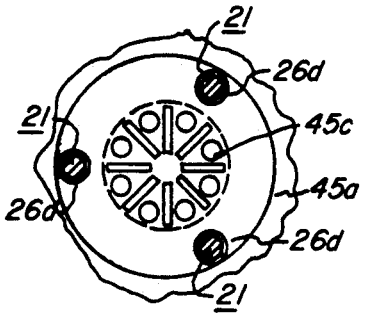
FIG. 3 is also a horizontal sectional detail on the same scale as and taken along the line III—III of FIG. 1.
Figure 7:
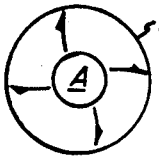
FIG. 7 is a greatly reduced horizontal depiction of the type of radial outward movement of charge materials within processing chambers defined by disc pairs of the rotating disc assembly of my illustrated apparatus.
Figure 4:
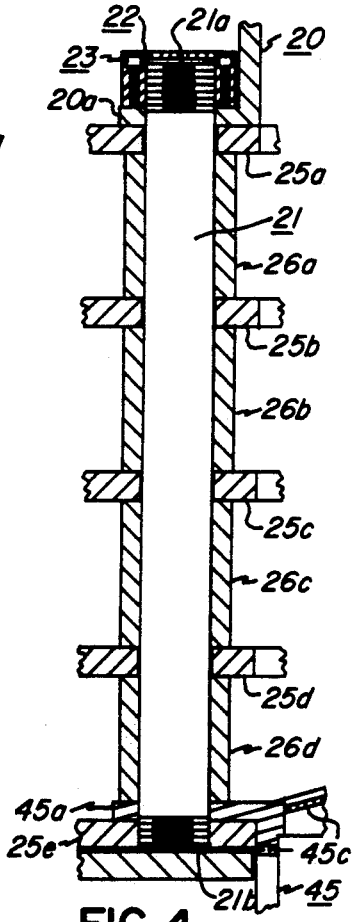
FIG. 4 is an enlarged fragmental section showing in detail the suspended mounting of chamber defining plates or discs by spaced-apart studs (see also FIGS. 1 and 3)

The type of in-feed of the charge bodies has both the advantage of limiting the size of the charge bodies supplied to the rotating duct 20 in order that they may freely move downwardly therein and into and along side chambers defined by radially extending disc or plates 25*a*, 25*b*, 25*c* and 25*d* of a tiered disc assembly 25. It also minimizes in-flow of air into the upper end of the duct with the charge bodies. The charge bodies being introduced will freely fall downwardly along central vertical chamber A defined by the duct 20 to enter a central, open-end processing chamber passageway C that is defined centrally by aligned central open portions of the disc assembly 25. The disc assembly is rotatably carried in a suspended and horizontally-radially outwardly extending relation from the duct 20 to rotate therewith. As shown, the assembly 25 has a series or group of horizontally-radially outwardly extending disc or plates 25*a*, 25*b*, 25*c*, 25*d*, and 25*e* that define charge body take-off levels in a vertically spaced relation with respect to each other, and that have a closely spaced clearance relation at their outer, circular edges with circular, enclosing side wall portions of the inside of the enclosure 10 (see FIG. 1) to define breaking-up or particulate-producing radial chambers for entering charge bodies. The arrows of reduced FIG. 7 show the vortex-like centrifugal movement of the bodies in such side chambers. The rotating disc structure or assembly 25 is centrally mounted in a suspended relation from a flange 20a about a lower end of the duct 20 (see FIGS. 1, 3, and 4) by a group of circumferentially spaced -apart assemblies consisting of end-threaded, through-extending studs 21, spacer sleeves 26a, 26b, 26c, and 26d, and through-extending end threaded bolts 28 and upper end cap nuts 22. The cap nuts 22 are shown tensioned and locked in position by inset screws 23. The lower threaded end 21b of each stud 21 is mounted in the last or bottom disc 25e of the assembly 25 and, as shown in FIGS. 1 and 2, extends through and is mounted through an upper, horizontally outwardly extending lip or flange portion 45a of a cup-like, centrally-positioned pressure-fluid-introducing hollow shaft or duct 45.

It will be noted that the duct 45 is aligned with the central passageway defined by the upper duct 20 and the disc assembly 25 and is journaled for rotation on a bottom closure plate 10b by ring bearing 48 that is carried in a mounting bracket 46 that is secured by bolts 47 on the plate.

Figure 2:
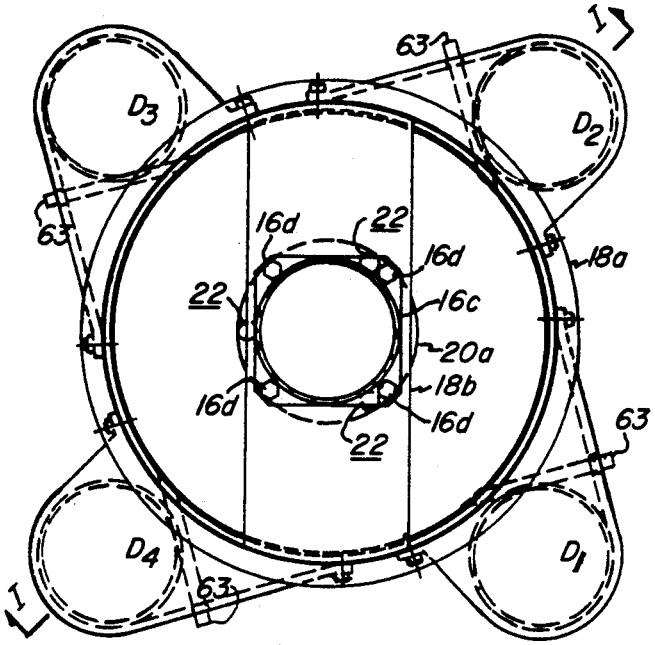
FIG. 2 is a horizontal section taken along the line II—II of and on the same scale as FIG. 1.
Figure 5:
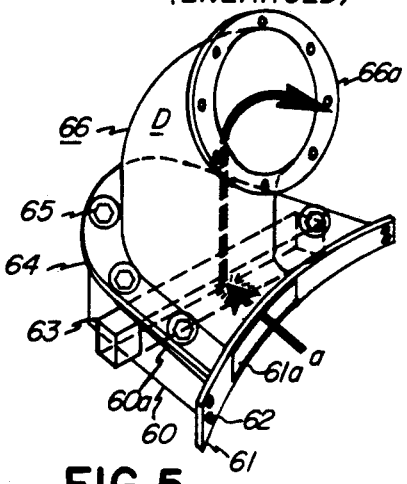
FIG. 5 is a slightly reduced perspective view showing a typical construction of a side-mounted, abutment-carrying, impact chamber assembly that is provided for each disc-defined, radial processing chamber and which serves to conduct the broken-up charge material into an upper collecting and commingling chamber of the apparatus.

As shown in FIGS. 1, 2, and 5, I have provided each disc-defined compartment with its own side-positioned, impact chamber at the bottom of break-up and particle or particulate return flow units, indicated generally as D. Each unit $D_1$, $D_2$, $D_3$ and $D_4$ has a lower box-like part 60 that is provided with a front mounting face plate or wall part 61 to be removably secured by bolts 62 over a side opening or window in the housing 10 that corresponds in shape and size to a front window portion 61a in the part 61. The window portion 61a substantially corresponds in its vertical depth to the vertical extent of the spacing between an aligned chamber defined between a pair of discs or plates, such as 25d and 25e and thus, as represented by an associated spacer sleeve, such as 26d. An upper cover plate 64 which serves as a mounting flange for an upwardly extending duct 66, is secured by bolts 65 ( see FIG. 5) to a top flange 60a of a lower box part 60 to define a final breaking-up chamber into which the load material is thrown (see the arrow "a") from an aligned compartment against a cross-extending abutment bar member 63. The member 63 is removably carried in a cross-extending relation within and across a frontal end portion of part 60 and is clamped in position by the plate 64. The cover plate 64 has an upwardly extending flow passageway defining duct 66 of a sufficient vertical extent such that its upper flange 66a may be secured by bolts 67 to an aligned open side window portion (see FIG. 1) in an upper portion of the enclosure wall 10 of the upper portion of the apparatus which defines the upper final particle commingling and sizing chamber B. The processed particles or particulates of the desired size are collected in the chamber B as they are separately fed from each chamber by an associated unit, such as generally designated as D, but with a length of duct 66 suited to the vertical mounted position of each unit with respect to the side wall of the housing 10.

A lower housing portion 10' of the enclosure serves as an enclosure for a positive upward flow of air or other flotation fluid through a mesh or grating 45c that is secured across an upper open end of a cup-shaped duct or hollow shaft 45 at lower end of the selection chambers of the disc assembly 25. The pressure of the fluid supplied to the central passageway through a side-mounted inlet 50 and its control valve 51 is regulated, in the first or uppermost disc-defined side chamber, to provide a radial in-flow of the lightest weight, usually smallest size, of the charge material into the first chamber defined between the discs 25a and 25b, and to cause charge material of progressively greater weight and usually larger size to progressively enter the disc-defined side chambers during their downward movement along the passageway C, with the heaviest entering the lowermost or last side chamber defined by the discs 25d and 25e.

The housing portion 10' also serves to carry and enclose equipment within lower chamber F for rotating the disc assembly within its upper and lower bearings 17 and 48. To assure an even and smooth actuation and control under variable feed conditions, I have shown a hydraulic motor $M_3$ as having its drive shaft connected through a gear assembly 49 to rotate the lower hollow shaft 48 that projects into the chamber F. An electric motor $M_2$ is shown mounted within the enclosure F to drive hydraulic pump P. An actuating liquid, such as oil, is introduced under pressure by the pump P through control valve V to a hydraulic motor $M_3$. The hydraulic oil is exhausted through line 52 to enter a cooler 0 which returns cooled oil through piping to the pump P for reuse. Air supplied to the chamber F thus serves a dual purpose in that it also, in its inflow into the chamber F, serves as a cooling medium in its application to the cooler O for oil used to operate the motor $M_3$.

Figure 6:
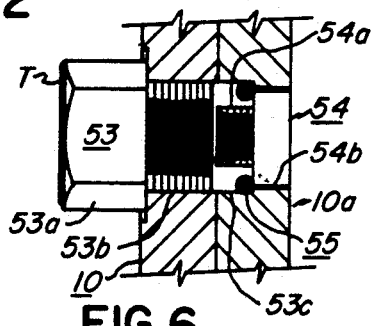
FIG. 6 is an enlarged sectional detail illustrating the mounting and construction of internal wear indicating inserts for wall portions of the apparatus.

In carrying out my invention, the feed of the charge material bodies of my fluid impact mill or comminuting apparatus, travels into the system on a vertically aligned centerline, and the spacing between the chamber defining discs or plates is sufficient to accept and pass the largest portion of the feed sizes of the charge material. I prefer a maximum feed size that is about one-half of the spacing provided between the discs. The pressure drop in the disc chambers between the inner to outer radii, as determined by the diameter of the discs, is selected to fluidize the solid charge material bodies as much as possible. Close tolerances are provided as to the feed into the duct chamber A to minimize air intake with the charge material bodies. The fluidizing results in relatively low energy requirements and wear rate on the equipment. However, I have shown an inner, wear-resistant liner 10a provided along the inside of the container or housing 10. Also, see particularly FIGS. 1 and 6, I show the provision of bolt-like wear-indicating assemblies T that may be removably mounted at any suitable portions of the housing wall 10. Each assembly T has a stud 53 provided with a wrench flat head 53a, a threaded mounting stem 53b, and an internally threaded end portion 53c for receiving a removably threaded pin end portion 54a of a wear indicating stud element or part 54. The joint defined between the stud element 54 and the stem 53 is sealed by an 0-ring 55 that is positioned within a seating recess about the portion 53c of the stud 53. The wear indicating part 54, as shown in FIG. 6, is adapted to be mounted in a flush relation with the inner surface of the housing wall 10 or other wear surface, such as the inner surface of the wear resistant liner 10a. Wear head portion 54b will be of the same material as exposed inside of the lining.

I prefer to operate the machine with an average speed of impact on outboard hammer abutments 63 of about 164 feet/second for most materials, varying depending on hardness and brittleness of the charge materials. There is about 180 degrees of rebound and colliding of the head stream which has hit the impact member or bar 63 with the following stream that is being projected outwardly from a given defined chamber. My apparatus maximizes tension break-up of the charge bodies, in that there is a pressure drop as the radius of the disc defined chamber increases. As an example, many minerals have a tensile strength of about one-tenth of their compressive strength. Fluidizing contributes greatly to low energy requirements, as does the low mass of the rotating discs with upper and lower hollow shafts.

The mounting tension rods or longitudinally extending studs 21 which hold the discs of the unit 25 together are shown mounted as close as practical to the center area. As an optimum they are moving at a speed that is similar to the speed of the feed of the charge material or bodies into the chambers between discs. Thus, the studs 21 have little impact with the feed bodies that are only beginning to accelerate at the inner radius of the duct-defined chamber. The pressure drop within each chamber, itself, causes partial breakage of the bodies as they are moved forwardly towards an associated impact shoulder unit $D_1$, $D_2$, $D_3$, $D_4$. Tests indicate that for optimum results, the radius of the central passageway along the disc defined chambers should not be more than about ⅓ of the radius of the chamber defining discs or plates, such as 25*a*, 25*b*, etc. for most types of feed material to both provide sufficient acceleration and pressure drop within the chambers. The hydraulic drive is preferred to maintain a constant speed under varying feed load or charge conditions. The edge speed of the discs which is the speed of the charge materials as they leave the chamber defined by the discs may therefore be maintained using a hydraulic drive.

Figure 9:
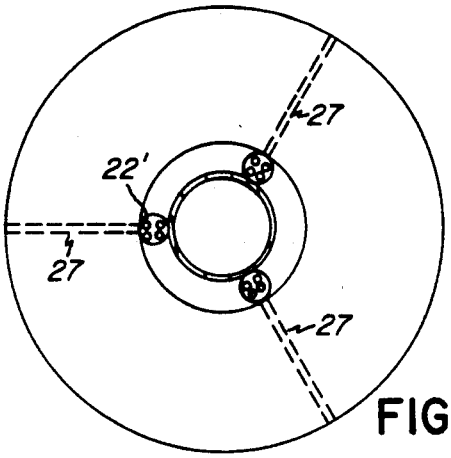
FIG. 9 is a horizontal sectional view on the same scale as and taken along the line IX—IX of FIG. 8.
Figure 8:
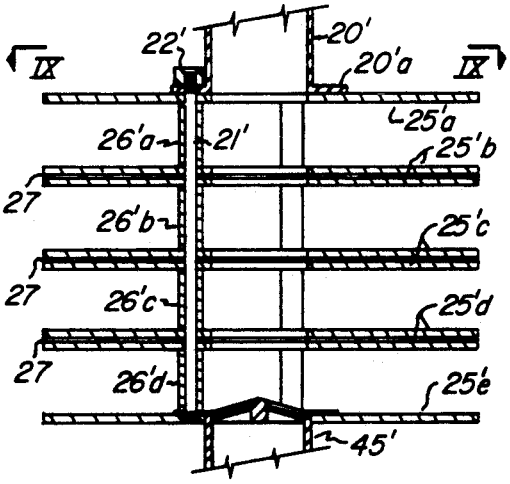
FIG. 8 is a vertical detail view in elevation on the scale of FIG. 1 showing a modified form of construction of a tiered, rotating disc assembly which, in its central reaches, enables an increased fluid flow throughout the system.

In the modified construction of FIGS. 8 and 9, intermediate plates or discs are provided and mounted as relatively closely spaced-apart groups, as 25'*b*, 25'*c* and 25'*d*, by means of radial spacer bars 27 to define fluid or air flow-spacing for greatly increasing the fluid flow through the system.

Figure 11:
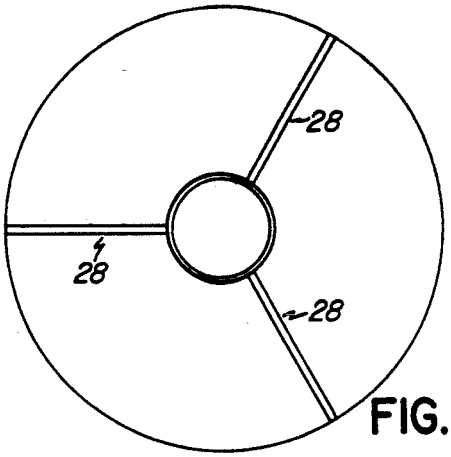
FIG. 11 is a horizontal section on the same scale as and taken along the line X—X of FIG. 10.
Figure 10:
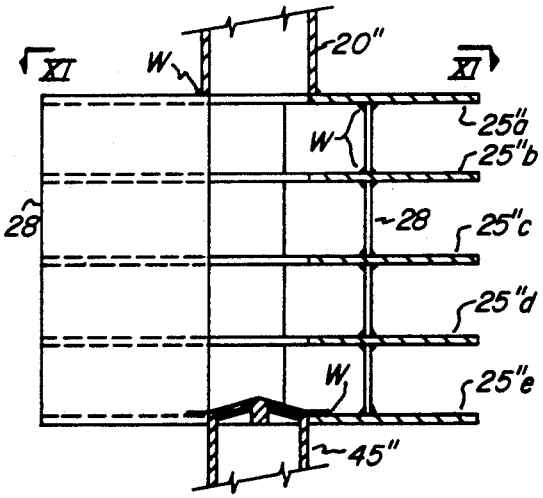
FIG. 10 is a vertical detail view in elevation on the same scale as FIG. 8 showing a tiered rotating disc assembly that is both mounted on its upper end by a supporting suspending duct and secured in an assembled relation by the use of weld metal.

In the construction of FIGS. 10 and 11, spacer sleeves 26*a*, etc. as well as bolts 21 of the construction of FIG. 1 are eliminated by, as shown, using weld metal W to secure the lowermost end of duct 20" to the uppermost disc or plate 25"*a* and providing a triangular group of radially-diagonally extending spacer bars or pieces 28 that are secured in position by weld metal W.

The following table is illustrative of runs taken employing a machine constructed in accordance with my invention:

TABLE I

| MOHS HARDNESS INDEX | TEST FEED MATERIALS | APPROX OPERATING R.P.M. | OUTEREDGE SPEED OF DISCS FT./SEC |
|---|---|---|---|
| 2.3 | *Muscovite Mica | 2,970 | 155.5 |
| 2.5 | **Bituminous Coal | 3,020 | 158.1 |
| — | Wet Coal Tailings | 3,120 | 163.4 |
| 3.7 | Dolomite Limestone | 3,315 | 164.9 |
| 5.3 | Limonite | 3,350 | 175.4 |
| 6.0 | Magnetite | 3,430 | 179.6 |
| 7.0 | ***Quartz | 3,450 | 180.6 |
| 9.1 | Calcined Alumina | 3,500 | 183.3 |

*Stained yellow with traces of pyrite from Lancaster City, PA.
**Pittsburgh seam coal from Green County, PA.
***White Quartz with traces of muscovite and galena The muscovite feed was in 1½×⅛ inch pieces, easily broken by hand, rather weathered, and from Lancaster County, Pa. The coal was 1¼×⅜ inch in size, taken from an underground seam within a few weeks of mining. The dolomite limestone was about 1×¼ inch in size of indeterminate age; the limonite was dug from a field in Beaver County; the magnetite was from the Mesabi area in Minnesota; the quartz was 1½×⅛ inch in size, somewhat weathered; the calcined alumina was ½×3/16 inch; and the coal tailings were ⅜×0 from an active pond in Washington County, Pa. The limonite was moist to the touch, and the coal tailings were of a high moisture content of about 60% by weight.

The need for a better comminuting apparatus has now become more acute in view of recently set up standards as to environmental requirements, such as represented by the Clean Air Act of 1991 and the need to make-use of locally available bituminous coal that has a high content of non-combustible, atmospheric-contaminating, locked-in material, such as the sulphur content. Limestone-based or other suitable comminuted additions may then be mixed-in to enable the removal of an additional 70 to 80% of the resulting sulphur dioxide from the coal to thereby comply with both Phase I and II of the Act. This not only meets the need for a low cost way to comply with CAA requirements, but assures that the economy of the soft coal region will not be adversely affected by the loss of its mining activists as presently greatly dependent on the coal burning electricity generating utilities.

What I claim is:

1. A comminuting apparatus for selectively breaking-up frangible charge material bodies into particles of a desired size and to free their value content which comprises, a vertically extending enclosure for the charge material bodies to be processed, an upper chamber within said enclosure for receiving broken-up particles of the charge material bodies, a lower chamber within said enclosure for processing the charge material bodies, a centrally-positioned feed duct for the charge material bodies extending centrally-downwardly along said upper chamber in closed-off relation with respect thereto, said duct having an open bottom end portion for discharging the charge material bodies therefrom, a disc assembly rotatably mounted to extend substantially centrally downwardly within said lower chamber and having a central open passageway therealong in a substantially vertically aligned and charge material receiving relation with respect to said open bottom end portion of said duct, said disc assembly having vertically spaced-apart radially-extending discs in a charge material body receiving and centrifugal force generating relation with respect to each other, means for rotating said disc assembly, means for introducing a fluid medium under positive pressure upwardly along said central passageway to introduce charge material bodies moving downwardly therealong from said duct into the spacings between discs in a downwardly progressive manner along said passageway in which those bodies of lightest weight are first-moved into the spacing between an uppermost pair of said discs and those of greatest weight are last-moved into the spacing between a lower-most pair of said discs, means for rotating said disc assembly to advance the charge material bodies introduced into the spacings between the discs of said assembly and project them centrifugally radially outwardly therefrom within said lower chamber, abrasive abutment means carried by said enclosure within said lower chamber in substantial radial alignment with the force-generating spacing between said discs for breaking-up the charge bodies projected under centrifugal force from the spacing between said discs, and a vertical passageway extending from each of said abutment means upwardly to deliver broken-up material particles into said upper chamber for outward delivery therefrom.

2. A comminuting device as defined in claim 1 wherein, a separate abrasion chamber is provided within said enclosure into which the spacing between each pair of said discs is open and within which one of said abrasive means is positioned, and said vertical passageways are isolated with respect to each other to separately deliver broken-up material particles into said upper chamber.

3. An apparatus as defined in claim 1 wherein said enclosure has an enclosing wall that is subject to wear on its inside surface from the charge bodies being processed, said wall has a through-extending hole portion therein, a wear button of substantially the same wear resistance as said inside surface is adapted to fit within said hole portion in a substantially flush relation with respect to said inside surface, and means is operative from an outer side of said wall for removably mounting said wear button in position within said hole portion of said wall.

4. An apparatus as defined in claim 1 wherein said disc assembly has means for securing at least one pair of said discs in an opposed closely spaced grouped relation to define a fluid through-flow radial passageway therebetween and that as a group has a relatively widely spaced-apart mounted relation with respect to an adjacent other one of said discs to define a radial through-flow path for charge material being introduced from said upper chamber into said lower processing chamber.

5. An apparatus as defined in claim 4 wherein said adjacent disc also has means securing it in said defined grouped relation with another one of said discs of said assembly to define a fluid through-flow radial passageway therebetween.

6. A comminuting apparatus for selectively break-up charge bodies of frangible material into particles of a desired size and in such a manner as to free their value content which comprises, an upright enclosure, means for feeding charge bodies into an upper end of said enclosure, an upper particle collecting and outflow chamber within said enclosure, a centrally positioned downwardly extending duct within said upper chamber for receiving the charge bodies from said feeding means and directing them centrally downwardly within said enclosure, a lower charge body processing chamber within said enclosure, a multiple disc assembly rotatably mounted within said lower chamber and defining a central vertical passageway therealong from said duct for receiving charge bodies therefrom, means for rotating said disc assembly within said enclosure, said disc assembly being operatively mounted for rotation in a radially outwardly extending relation with respect to said passageway within said enclosure and having vertically spaced-apart radially-extending discs defining a vertically disposed and horizontally extending group of material processing chambers in vertical progression with respect to each other to receive charge bodies fed downwardly along said passageway from within said duct, said enclosure having an enclosing side wall within which said disc assembly is adapted to rotate and that is provided with circumferentially spaced-apart and radially outwardly offset abutments against which the charge bodies are thrown from within said group of processing chambers during rotative movement of said disc assembly, return flow passage means extending from said abutments to deliver broken-up charge material into said upper chamber, said duct and said enclosing side wall defining said upper chamber for receiving broken-up charge material from said return flow passage means, means for introducing a fluid medium under positive pressure into said enclosure and positively upwardly along inner reaches of said disc assembly and into said group of chambers of said disc assembly to provide a selective movement of the charge bodies into said group of chambers along the vertical extent of said disc assembly on the basis of their weight to fluid-floatable relation in which lighter bodies are scaled to the heavier bodies and moved selectively into said chambers progressively downwardly along said disc assembly and are broken-up therein and in outward projection against said abutments and are then moved upwardly along said return flow passage means into said upper collecting and outflow chamber.

7. A comminuting device, as defined in claim 6 wherein, said disc assembly is secured in a suspended relation from said duct, said means for rotating said disc assembly includes a drive portion at a lower end of said disc assembly, and a motor is operatively connected to said drive portion.

8. A comminuting device, as defined in claim 6 wherein, said enclosure has a bottom grating open substantially centrally into a lower end portion of said disc assembly, and means for introducing the fluid medium under pressure through said grating into a lower end of said passageway of said disc assembly and then radially into and outwardly from the group of chambers between the discs of said assembly.

9. A comminuting device, as defined in claim 8 wherein, a motor drive compartment is positioned within a lower end portion of said upright enclosure and below said grating; an electric motor, a hydraulic pump, an oil cooler and a hydraulic motor constitute said means for rotating said disc assembly and are operatively mounted in said motor drive compartment and connected to rotate said disc assembly; and means is provided for introducing the fluid medium into said compartment to thereby cool said equipment before the fluid medium is introduced through said grating into said disc assembly.

10. A comminuting device, as defined in claim 6 wherein, said enclosure has a lower enclosed compartment below said disc assembly; said rotating means comprises an electric motor, a hydraulic motor, a hydraulic pump, a hydraulic oil flow control valve, and an oil cooler are positioned din said compartment in an operating relation in which said electric motor drives said pump, said pump is connected through said control valve to drive said hydraulic motor, and said hydraulic motor is operatively connected to a lower end of said disc assembly for rotating it.

11. A method of comminuting charge bodies of a breakable material into particles of smaller size in a walled enclosure which comprises, introducing and moving the bodies substantially centrally downwardly within an inner chamber portion of the enclosure under gravity and an upwardly opposing positive fluid flow along a vertically progressive series of horizontally sidewise-extending fluid flow chambers, while selectively and progressively first moving charge bodies of lesser weight and then those of gradually greater weight radially out of a downflow path and into and outwardly along the flow chambers, imploding the bodies within the flow chambers and turbidly moving them radially outwardly under centrifugal force towards an inner periphery of the enclosure and into breaking-up impingement against abutment portions of the enclosure, and then moving the thus impinged now smaller size bodies in an upwardly flowing isolated relation along vertically extending inner wall portions of the enclosure and in a now particulized condition into an upper collecting chamber portion of the enclosure that is segregated from the inner chamber portion thereof.

12. A method as defined in claim 11 wherein a selective and progressive outflow of the charge bodies into and along the flow chambers is effected on the basis of their respective weights by a positive counter upflow of a fluid along the downflow path of the charge bodies.

13. A method as defined in claim 11 wherein at least one separate radial through-flow path of lesser spacing size is provided and fluid is moved radially outwardly therealong and towards the inner periphery of the enclosure to increase fluid upflow along the vertically extending inner wall potions of the enclosure.

* * * * *